US005920747A

United States Patent [19]

Takemoto et al.

[11] Patent Number: 5,920,747

[45] Date of Patent: Jul. 6, 1999

[54] IMAGE FORMING APPARATUS FOR STABILIZING THE DENSITY OF DOT IMAGES

[75] Inventors: Shinichi Takemoto; Yasuyuki Inada, both of Toyokawa, Japan

[73] Assignee: Minolta Co., Ltd., Osaka, Japan

[21] Appl. No.: 09/094,614

[22] Filed: Jun. 15, 1998

Related U.S. Application Data

[63] Continuation of application No. 08/815,767, Mar. 12, 1997, Pat. No. 5,774,762.

[30] Foreign Application Priority Data

Mar. 13, 1996 [JP] Japan ..... 8-56050
Mar. 13, 1996 [JP] Japan ..... 8-56456

[51] Int. Cl.[6] ..... G03G 15/08

[52] U.S. Cl. ..... 399/53; 399/55; 399/56

[58] Field of Search ..... 399/38, 46, 49–51, 399/53, 55, 56, 72

[56] References Cited

U.S. PATENT DOCUMENTS 4,505,572 3/1985 Ashida et al. ..... 399/22
4,796,065 1/1989 Kanbayashi ..... 399/60
5,107,302 4/1992 Bisaiji ..... 399/59
5,124,750 6/1992 Naito ..... 399/55
5,315,352 5/1994 Nakane et al. ..... 399/49

FOREIGN PATENT DOCUMENTS 8-211722 8/1996 Japan .

*Primary Examiner*—William Royer
*Attorney, Agent, or Firm*—McDermott, Will & Emery

[57] ABSTRACT

In an electrophotographic image forming apparatus, the density of a dot image is stabilized by detecting the toner density of a first standard toner image having toners of a uniform density formed on a photoconductor, adjusting the development bias voltage applied to a development device according to the detected toner density. The adjusted development bias voltage is used to form on the photoconductor a second standard toner image having toners of dots with predetermined spaces there between. Then, an area ratio of dot area to unit area of the second standard toner image is detected and is used to control the image forming conditions of the image forming apparatus to stabilize the density of a dot image.

11 Claims, 11 Drawing Sheets

IMAGE FORMING APPARATUS FOR STABILIZING THE DENSITY OF DOT IMAGES

This is a continuation of U.S. patent application Ser. No. 08/815,767, filed Mar. 12, 1997, issuing on Jun. 30, 1998, as U.S. Pat. No. 5,774,762.

BACKGROUND OF THE INVENTION

1. Field of the Invention

The present invention relates to an image forming apparatus, and in particular to an electrophotographic image forming apparatus for expressing gradation with print area ratio.

2. Description of Prior Art

In an image forming apparatus, it is required to form an image with reproducible colors and densities. Then, before the process of forming an image according to image data is started, a standard toner image is formed in predetermined standard conditions in a non-image area on a photoconductor which is not related to the image forming, and the density of the standard toner image is detected with a density sensor. Then, image forming conditions such as the developing bias voltage, the surface potential of the photoconductor, the optical intensity of exposure are controlled according to the detected density.

However, the toner density to be detected is affected by the charging characteristic of the photoconductor, the development bias characteristic or the like. Especially for a standard toner image consisting of a plurality of dots, the size or diameter of the dots is changed, and this changes the toner density. If the humidity or temperature is changed, the amount of charges on toners per unit weight is affected, and this changes the density of the standard toner image. If the image forming conditions are set according to the density changed by the above-mentioned factors, a desired image may not be obtained.

Further, even if the density of the standard toner image is detected correctly, when the transfer efficiency is changed, a desired image may not be obtained. Therefore, transfer efficiency has to be taken into account in the image stabilization.

SUMMARY OF THE INVENTION

An object of the present invention is to provide an image forming apparatus which can reproduce colors and densities of an image stably by controlling image forming conditions appropriately.

In one aspect of the invention, in an image forming apparatus, an electrostatic latent image is formed by exposing a photoconductor and is developed to form a toner image on a photoconductor according to image data and the toner image is transferred onto a transfer material. Image forming conditions are controlled before forming an image according to image data. A first detector detects a resistance value of the transfer material, while a second detector detects an amount of toners of the standard toner image formed on the photoconductor in predetermined image forming conditions. Then, a voltage to transfer a toner image onto the transfer material is controlled according to the resistance value and the amount of toners.

In a second aspect of the invention, a first detector detects a resistance value of the transfer material. On the other hand, a second detector detects an amount of toners of the standard toner image formed on the photoconductor in predetermined image forming conditions, and a second voltage to be applied to a developmental device is adjusted according to the detected amount of toners. Then, a voltage to transfer a toner image onto the transfer material is controlled according to the resistance value and the second voltage.

In a third aspect of the invention, a first standard toner image having toners of a uniform density is formed on the photoconductor, and a toner density of the first standard toner image is detected. Then, a development bias voltage applied to a development device is adjusted according to the detected toner density. On the other hand, a second standard toner image having toners of dots with predetermined spaces between them is formed on the photoconductor with the adjusted development bias voltage, and an area ratio of dot area to unit area of the second standard toner image is detected. Then, at least one of an amount of charges for charging the photoconductor uniformly, an intensity of the light beam for exposing the photoconductor and the development bias voltage is controlled according to the detected ratio. In particular, a setting means is used to set the development bias potential applied to the development device and the surface potential of the photoconductor according to the toner image formed by the development device, and a controller is used to change the size of the dots for forming an image according to the surface potential set by the setting means.

An advantage of the present invention is that the transfer efficiency is stabilized by controlling the transfer voltage by taking into account the resistance of the intermediate transfer material, the charges of adhered toners and the development bias voltage so that a stable image can be output with reproducible colors and densities.

Another advantage of the present invention is that a density of a dot image can be stabilized precisely by detecting the thickness and extension of toners adhered to the photoconductor.

BRIEF DESCRIPTION OF THE DRAWINGS

These and other objects and features of the present invention will become clear from the following description taken in conjunction with the preferred embodiments thereof with reference to the accompanying drawings, and in which.

DETAILED DESCRIPTION OF THE PREFERRED EMBODIMENTS

Figure 1:
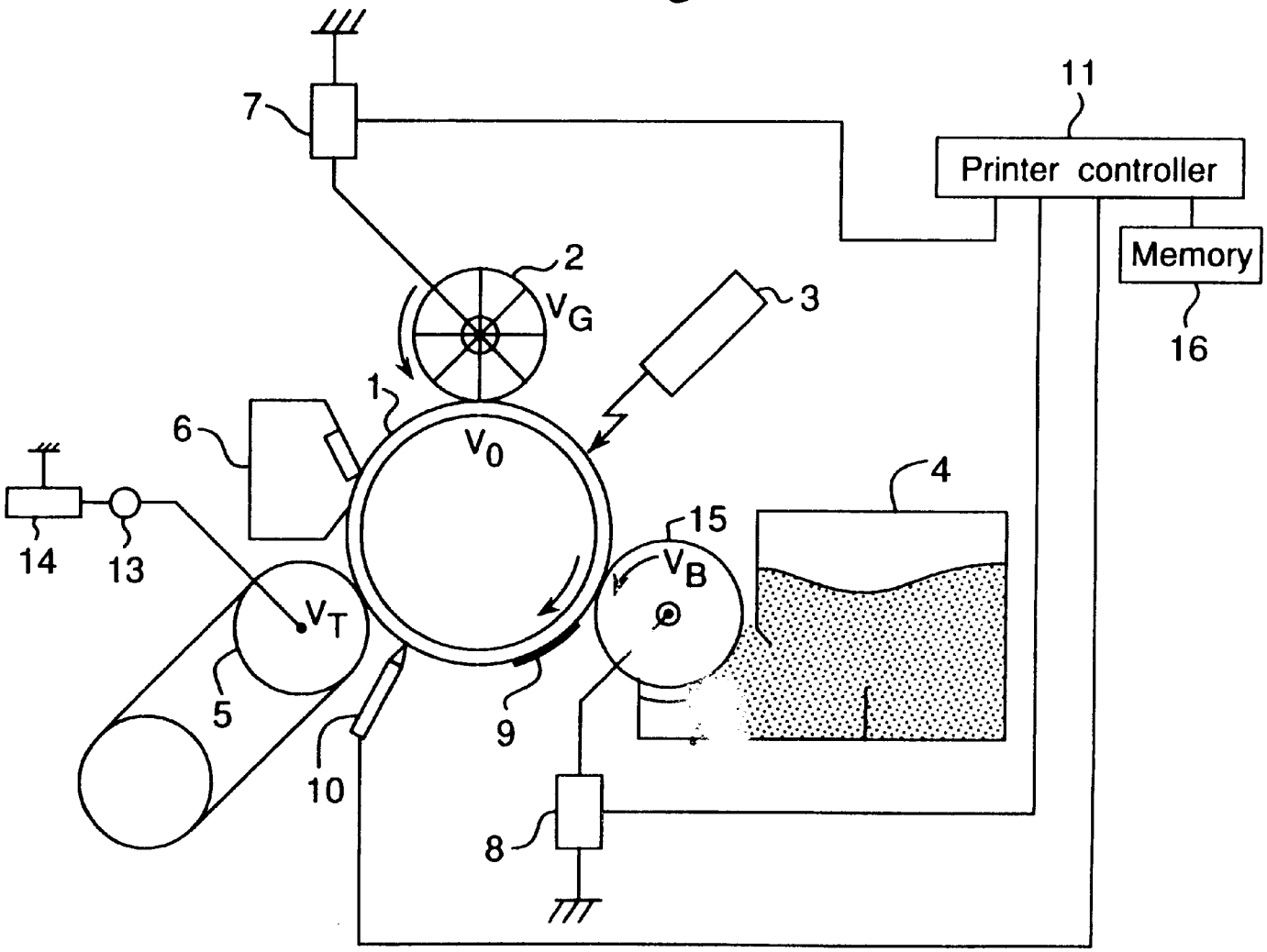
FIG. 1 is a schematic sectional view of an electrophotographic copying machine of an embodiment of the invention.

Referring now to the drawings, wherein like reference characters designate like or corresponding parts throughout the views, FIG. 1 shows an electrophotographic copying machine of an embodiment of the invention. The copying machine uses an area gradation process for expressing gradation with coarse or dense distribution of dots or lines. A photoconductor drum 1 having an organic photoconductor on its surface for forming an electrostatic latent image is rotatable clockwise as shown with an arrow in FIG. 1. A charging brush 2, a laser exposure unit 3, a development device 4 having a development sleeve 15, an image sensor 10, an intermediate transfer unit 5 having a belt and a cleaner unit 6 are provided around the photoconductor drum 1 successively. The surface of the photoconductor drum 1 is charged uniformly with the charging brush 2 to which a high voltage is applied by a power source 7. Then, the laser exposure unit 3 modulates a laser beam according to image data to form an electrostatic latent image on the surface of the photoconductor drum 1. The development device 4 comprises four development units for colors of cyan, magenta, yellow and black though only one unit is shown in FIG. 1 for the ease of the explanation. A bias voltage $V_B$ is applied to the sleeve 15 by a power source 8. A printer controller 11 having a central processing unit selects a development unit for cyan first, and the development unit develops the latent image with cyan toners to form a toner image 9. The intermediate transfer unit 5 has a belt made of an electrically conducting resin. A transfer voltage $V_T$ having a polarity reverse to that of the toners is applied to the belt by a power source 14 through a current detector 13. The current detector 13 is provided to measure the resistance of the intermediate transfer material of the intermediate transfer unit 5. Then, the toner image is transferred onto the belt electrostatically by the transfer voltage $V_T$. Toners remained on the belt after the transfer are recovered by the cleaner unit 6. The above-mentioned charging, exposure, development and transfer are repeated in the order of cyan, magenta, yellow and black to overlap the toner images of the four colors on the intermediate transfer unit 5. Then, the layered toner images are transferred onto a paper (not shown) electrostatically and fixed thereon by a fixing unit (not shown). Thus, an image is formed on a paper.

In order to produce always the same image for the same image data, image forming conditions have to be controlled such as the surface potential $V_o$ of the photoconductor drum 1 or the development bias voltage $V_B$ of the development device 4. In order to control the image forming conditions, before an image is formed, a first standard dot toner image 91 and a second standard uniform density toner image 92 are formed, and the image sensor 10 detects an area ratio of the first standard dot toner image 91 and an amount of adhered toners (or thickness) of the second standard uniform density toner image 92. A memory 16 connected to the printer controller 11 stores a plurality of look-up tables for controlling image forming conditions, the detected value of the image sensor 10 and the setting values for the power sources 7, 8. The printer controller 11 controls the surface potential $V_O$ and the development bias voltage $V_B$ according to the detected values with reference to the look-up tables stored in the memory 16. Details of the control of image forming conditions are explained below.

Figure 2:
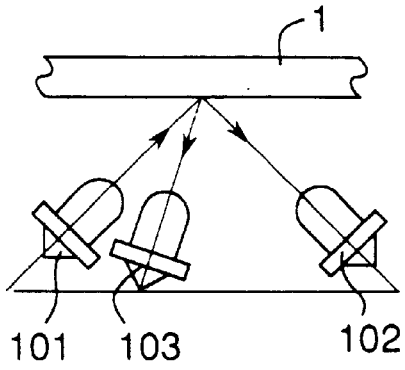
FIG. 2 is a elevational view of an image sensor.

FIG. 2 shows the image sensor 10 comprising a light emitting diode 101 to illuminate a standard toner image formed on the photoconductor drum 1 at a predetermined angle, a photosensor 102 to detect the light from the light emitting diode 101 reflected by the standard toner image at the normal reflection angle, and another photosensor 103 to detect scattered light from the standard toner image.

Figure 3:
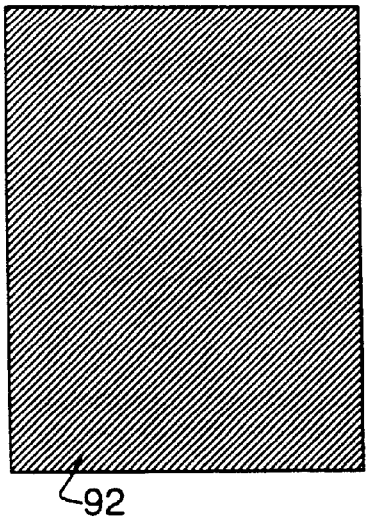
FIG. 3 is a schematic diagram of a standard uniform density toner image.
Figure 4:
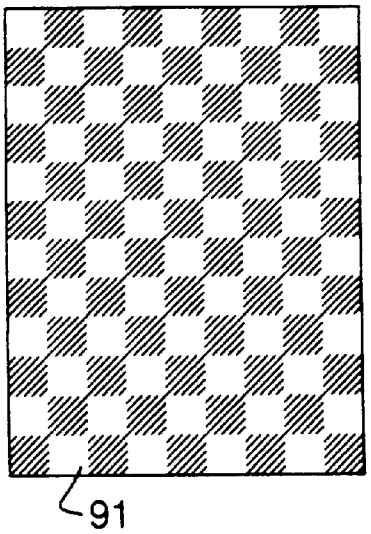
FIG. 4 is a schematic diagram of a standard dot toner image.

The printer controller 11 forms the second standard uniform density toner image 92 shown in FIG. 3 and the first standard dot toner image 91 shown in FIG. 4. First, in order to detect the thickness of toners adhered to the photoconductor drum 1, the second standard uniform density toner image 92 shown in FIG. 3 is formed on the photoconductor drum 1. The second standard uniform density toner image 92 is an image with a uniform density formed by always turning on the laser exposure unit 3. The photosensor 103 detects the light emitted by the light emitting diode 101 and scattered by the toners. Next, in order to detect the area ratio of a dot image, the first standard dot toner image 91 shown in FIG. 4 is formed on the photoconductor drum 1. The first standard dot toner image 91 is a dot image formed by turning on and off the laser exposure unit 3 at a predetermined period. The photosensor 102 detects the light emitted by the light emitting diode 101 and reflected normally by the toners. The normal reflection means that the light is reflected at the same angle as the incident angle. As mentioned above, at a first stage, the standard uniform density toner image 92 is formed to detect scattered light by the photosensor 103. Thus, the amount of adhered toners of the standard uniform density toner image is determined. Next, in a second stage, the standard dot toner image 91 is formed to detect the normally reflected light by the photosensor 102. Thus, the area ratio of the standard dot toner image is detected.

Figure 5A:
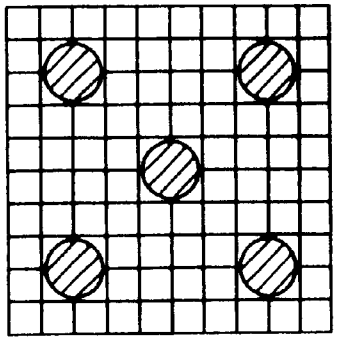
FIGS. 5A, 5B, 5C, 5D, 5E and 5F are schematic diagrams for explaining a change in intensity of reflected light for various dot sizes.
Figure 5B:
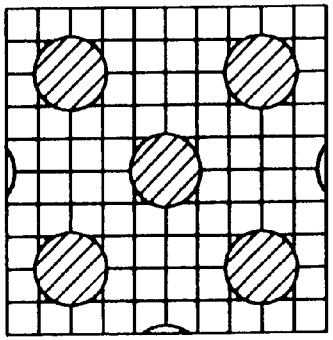
Figure 5C:
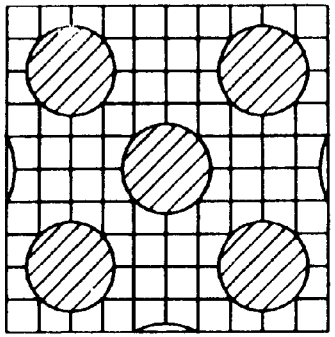
Figure 5D:
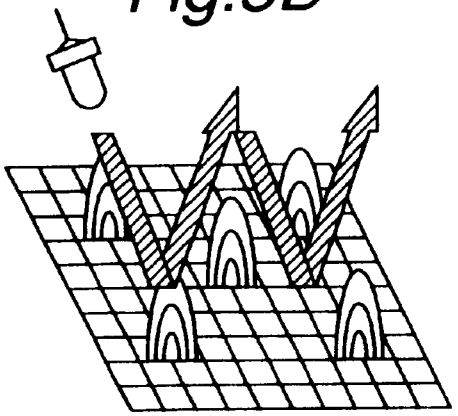
Figure 5E:
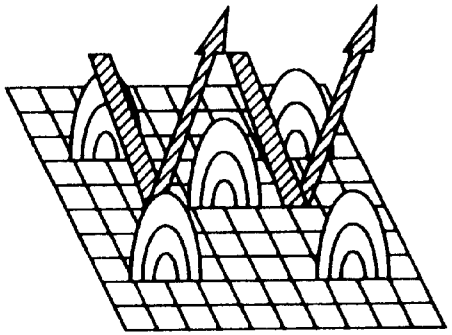
Figure 5F:
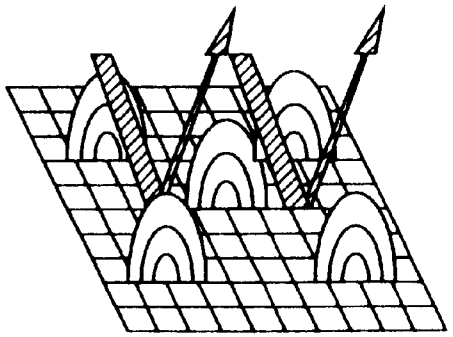

Next, the detection of the area ratio of the standard dot toner image is explained further. FIGS. 5A, 5B and 5C show dots shown with circles with hatching. As the dot size increases in the order of FIGS. 5A, 5B and 5C, the intensity of normally reflected light decreases as shown with the width of arrows for reflected lights in FIGS. 5D, 5E and 5F. This is based on a fact that the incident light from the light emitting diode 101 is harder to be scattered on the surface of the photoconductor drum 1 having no adhered toners while most of them are reflected normally, and that most of the incident light is reflected largely at a toner image and the light along the normally reflecting direction becomes weaker. That is, most of the light detected by the photosensor 102 is a normally reflected light from the surface with no adhered toners of the standard dot toner image 91. Therefore, the area ratio of the standard dot toner image 91 is determined according to the detected value by the photosensor 102. If the detection range of the photosensor 102 is limited, the detected values scatter largely according to the position of the measured range. In order to detect the normally reflected light from many dots stably, it is preferable that the light emitting diode 101 and the photosensor 102 do not have so much directivity and that the incident angle of the light emitted by the light emitting diode 101 becomes wider against a normal of the photoconductor drum 1.

Figure 6A:
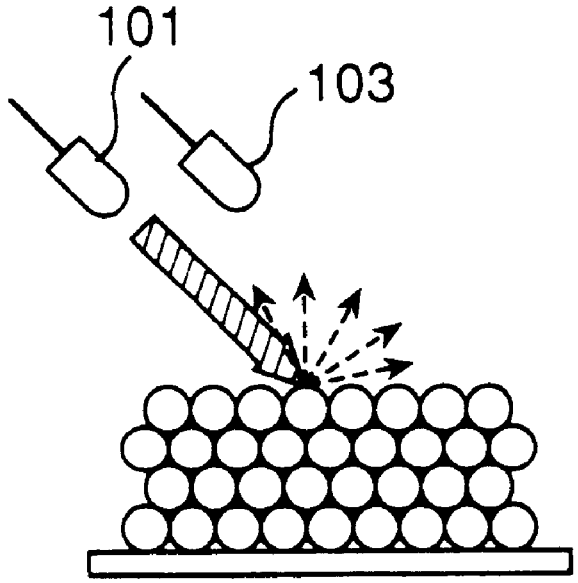
FIGS. 6A and 6B are diagrams for explaining a change of the intensity of scattered light according to the thickness of toners.
Figure 6B:
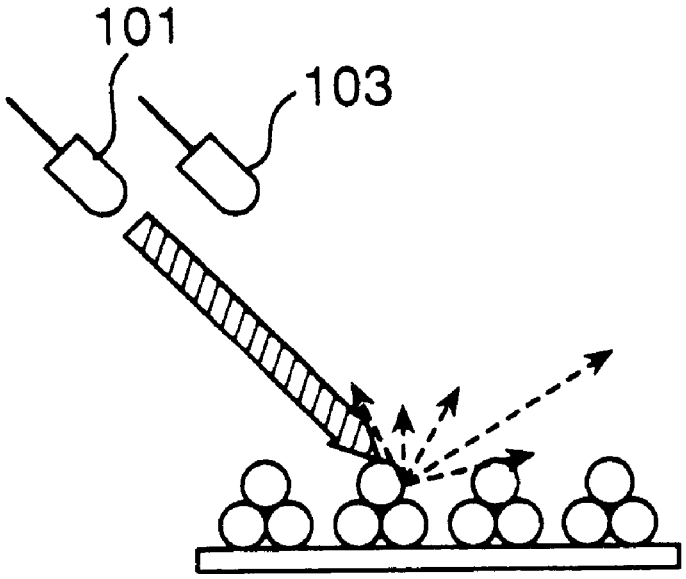

Next, the detection of the thickness of toners adhered to the photoconductor drum 1 is explained. FIGS. 6A and 6B explain a change in the intensity of scattered light according to the thickness of toners. The directions and the lengths of the arrows in FIGS. 6A and 6B represent directions and intensities of reflected lights. FIG. 6A shows that most of the light is reflected randomly and uniformly when the amount of adhered toners is large. FIG. 6B shows that most of the light is reflected along the normally reflecting direction when the amount of adhered toners is small. As the amount of adhered toners is increased, the quantity of normally reflected light decreases, while the intensity of randomly reflected light increases. Therefore, it seems at first that the thickness of toners of the uniform density toner image is detected according to the intensity of normally reflected light of the photosensor 102. However, the light detected actually by the photosensor 102 includes both normally reflected light and randomly reflected light. As mentioned above, as the amount of adhered toners is increased, the intensity of normally reflected light decreases but that of randomly reflected light increases. Then, the sum of the two lights changes only a little for the uniform density toner image as the amount of adhered toners is increased, in contrast to the dot toner image density. If the photosensor 102 has narrow directivity to detect only the normally reflected light, this contradicts the condition required for the photosensor 102 to detect the area ratio of the standard dot toner image 91. Then, in this embodiment, the second photosensor 103 is provided to detect the randomly reflected light precisely. Then, the thickness of toners is determined according to the detected value of the randomly reflected light from the standard uniform density toner image 92. The second photosensor 103 is set at a position near the light emitting diode 101 inside an angle between the light emitting diode 101 and a normal of the photoconductor drum 1 extending from a position at which the light beam from the light emitting diode 101 is incident, in order to detect only the scattered light without being affected by the normally reflected light. In other words, the second photosensor 103 is set at the same side as the light emitting diode 101 with respect to the normal of the photoconductor drum 1.

The copying machine uses an area gradation method to express gradation. The laser exposure unit 3 performs bi-level exposure on the photoconductor drum 1 according to image data subjected to area gradation processing. The sizes or diameters of dots of the standard dot toner image 91 are increased or decreased from a reference value according to the humidity or temperature. When the dot size is larger, the area ratio, that is, a ratio of the area of the toner dots to unit area becomes larger, and the density becomes larger. The density of the standard dot toner image is also affected by the thickness of toners or the amount of toners adhered on a unit area. If the dot size is kept the same, the density becomes larger for an image having thick toners.

Figure 7:
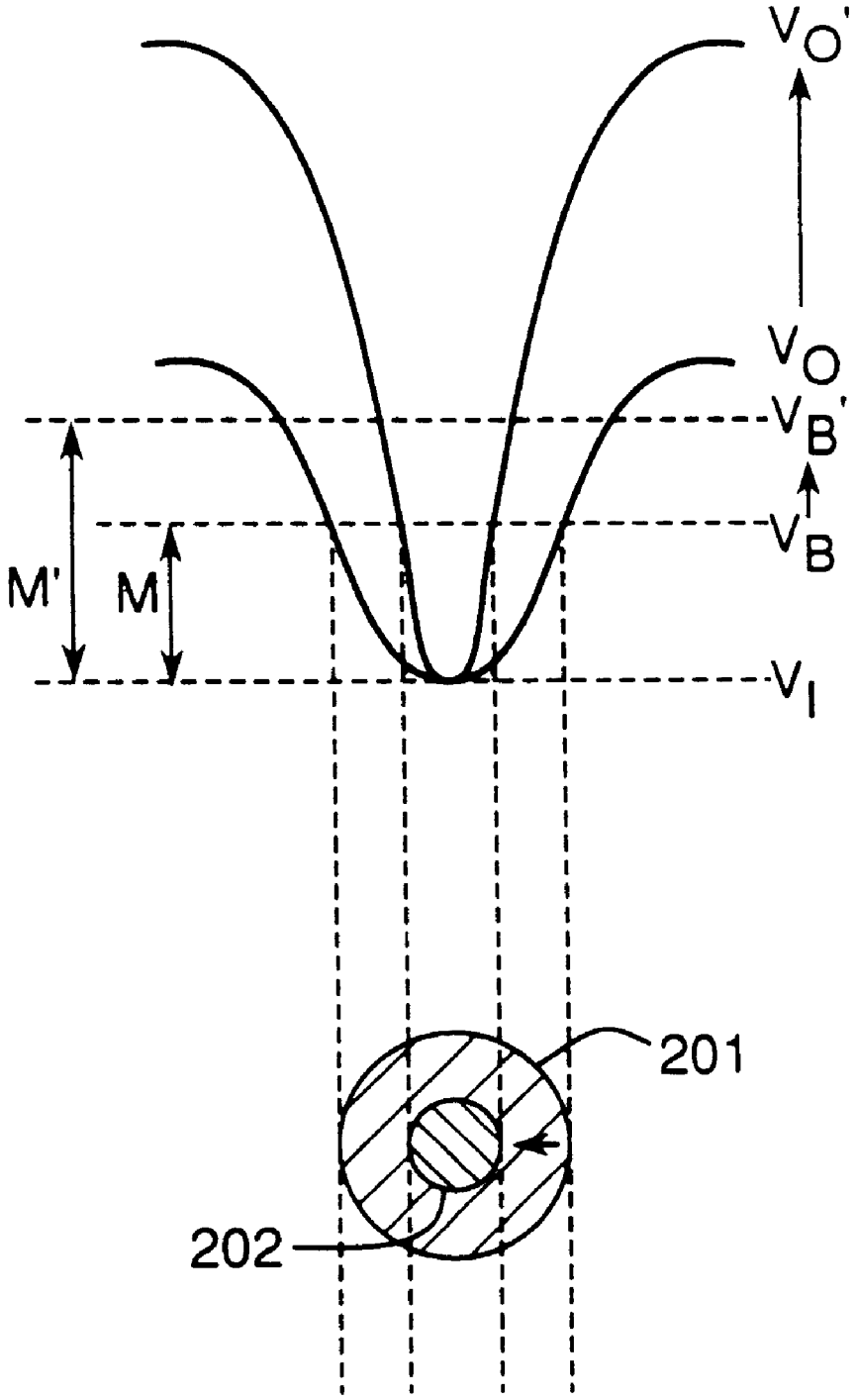
FIG. 7 is a diagram for illustrating a relation between the surface potential $V_o$, development bias voltage $V_B$ and a size of dots formed on the photoconductor drum.

FIG. 7 illustrates a relation between the surface potential $V_O$, the development bias voltage $V_B$ and a size of dots formed by exposing the photoconductor drum 1 with the laser exposure unit 3. The size and thickness of dots are controlled by the surface potential $V_O$ of the photoconductor drum 1 charged by the brush 2 and by the development bias potential $V_B$ applied to the development sleeve 15 by the power source 8. Before exposure by the laser exposure unit 3, a negative surface potential $V_O$ is applied to the photoconductor drum 1, while a negative low bias voltage $V_B$ (satisfying $|V_B|<|V_O|$) is applied to the surface of the development sleeve 15 of the development device 4. As the photoconductor drum 1 is rotated, the surface charged at the surface potential $V_O$ reaches a position which opposes the laser exposure unit 3. When it is exposed by the laser exposure unit 3, the surface potential $V_O$ decays to a potential $V_I$. As shown in the upper part of FIG. 7, the intensity of exposure light is adjusted to decay the surface potential to the minimum. The amount of adhered toners increases in proportion to development voltage $\Delta V=|V_B-V_I|$. For example, if the development bias voltage $V_B$ is changed to $V_B'$, the amount of adhered toners is increased from a dot 201 to 202 accordingly as the development voltage is changed from M to M', as shown in the lower part of FIG. 7. As the surface potential $V_O$ increases, the potential gradient becomes steeper, as shown in the upper part of FIG. 7. If the development voltage $\Delta V$ is kept the same, the size of dots formed on the photoconductor drum 1 is changed according to the surface potential $V_O$. As shown in the lower part of FIG. 7, the dot 201 for the surface potential $V_O$ is smaller than the dot 202 for the surface potential $V_O'$. Thus, the amount of adhered toners is controlled by the development bias voltage $V_B$ and the dot size is controlled by the surface potential $V_O$. Then, the printer controller 11 detects the area ratio of the standard dot toner image 91 and the amount of adhered toners of the standard uniform density toner image 92 with the image sensor 10 and controls the development bias voltage $V_B$ and the surface potential $V_O$ to stabilize an image.

Figure 8:
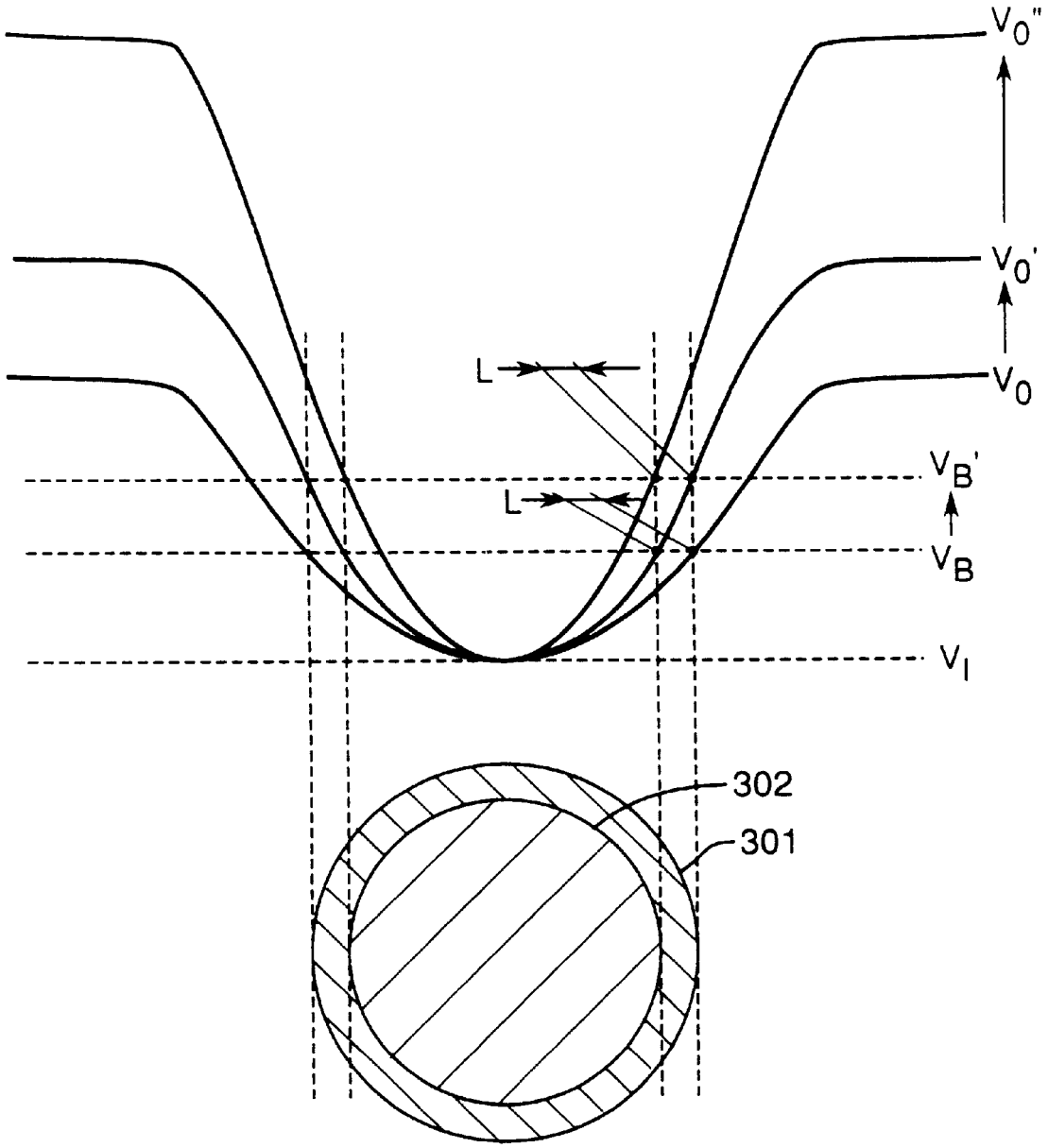
FIG. 8 is a diagram for illustrating a change in surface potential for changing the size of dots formed on the photoconductor drum.

FIG. 8 shows a change in surface potential distribution on the surface of the photoconductor drum 1 caused by exposure thereto, for illustrating the control of dot size on the photoconductor. As explained above with reference to FIG. 7, the dot size depends on the surface potential $V_O$. In order to decrease the diameter of a dot 301 by 2L to 302 in FIG. 8 without changing the development bias voltage $V_B$, the surface potential is changed to $V_O'$. In the case of the surface potential $V_O'$, the dot 301 is formed by setting the development potential at $V_B'$. Then, when a dot size is changed by the surface potential $V_O$, it will be understood that as the surface potential $V_O$ becomes higher, a change in surface potential needed to change the dot size increases rapidly.

A fog may occur if a difference between the surface potential $V_O$ and the development bias voltage $V_B$ is large. On the other hand, if the potential difference is small, randomness in an image occurs because the image is affected by the randomness of the surface potential $V_O$. Therefore, it is necessary to keep the potential difference within a predetermined value. Then, when the surface potential $V_O$ is large to some extent, the development bias voltage $V_B$ is controlled in a range which does not affect the amount of adhered toners largely. Thus, the dot size is controlled, while the above-mentioned image noises are prevented.

Figure 9:
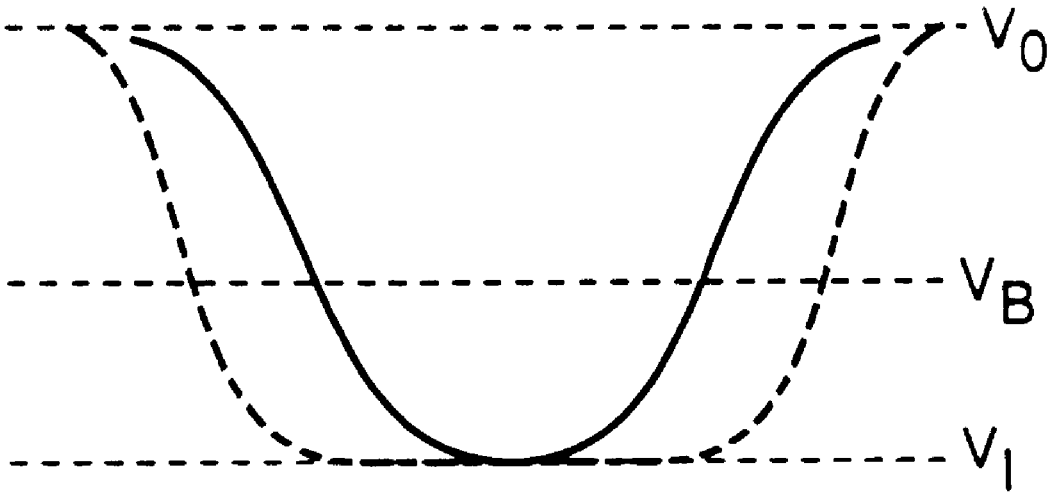
FIG. 9 is a diagram for illustrating an area where the potential decays for a normal intensity of exposure light and for a larger intensity of exposure light.

FIG. 9 illustrates a potential distribution on the surface of the photoconductor drum 1 caused by exposure by the laser exposure unit 3. The intensity of exposure by the laser exposure unit 3 is set at a value to decay the surface potential to the minimum decay potential $V_I$ for the distribution shown with a solid line. If the intensity of exposure is increased further, an area of the minimum decay potential $V_I$ extends in directions to increase the dot size, as shown with a dashed line, that is, the area extends in directions to expand the width of the area having the potential smaller than $V_B$. Therefore, when the surface potential $V_O$ is large to some extent, the dot size is controlled by controlling the development bias voltage $V_B$, and/or by increasing the intensity exposure of the laser exposure unit 3 higher than an ordinary value.

Figure 10:
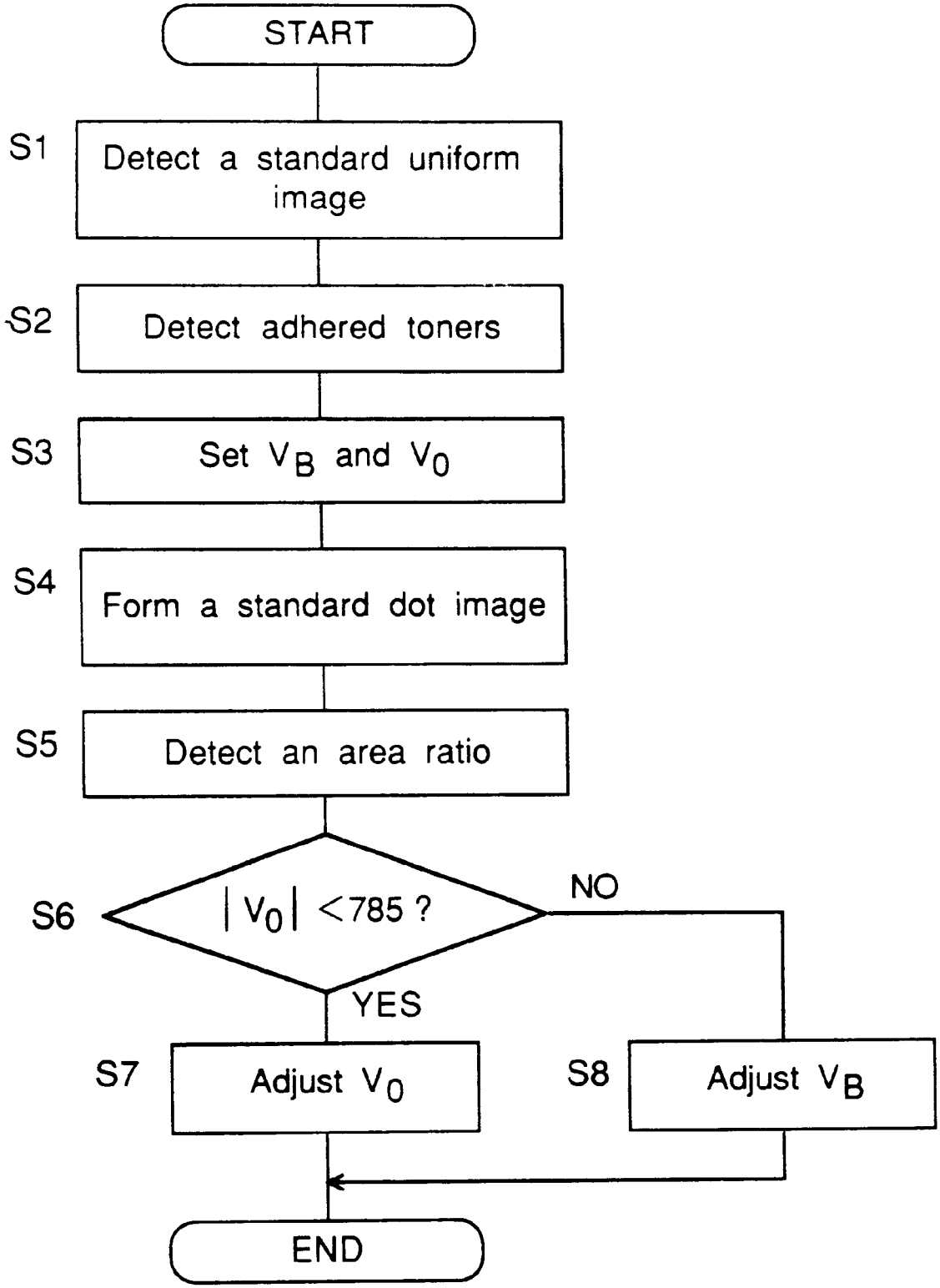
FIG. 10 are a flowchart of the control of image forming conditions.

FIG. 10 is a flowchart of the control of image forming conditions performed by the printer controller 11. This image stabilization processing is performed in correspondence of input data from sensors such as the image sensor 10. However, the image stabilization cannot be controlled precisely if the sensitivity of the sensor is low. In general, the measurement range of a high sensitivity sensor is narrower than that of a low sensitivity sensor. Further, even if a high sensitivity sensor is used, there are image forming conditions where the detection cannot been performed effectively. Then, this has also be taken into account in the control of image forming conditions.

First, a standard uniform density toner image 92 is formed in a non-image area on the photoconductor drum 1 by using a predetermined development bias voltage $V_B$ and a predetermined surface potential $V_O$ (step S1). Then, the amount of adhered toners is detected by the image sensor 10 and it is stored in the memory 16 (step S2). By referring to Table 1 stored in the memory 16 and the detected amount of toners, the development bias voltage $V_B$ for obtaining a desired amount of adhered toners is set, and a temporary surface potential $V_O$ is also set in correspondence to the development bias voltage $V_B$ (step S3). The two setting values are stored in the memory 16.

Table 1 Setting values of $V_B$ and $V_O$ determined according to the amount of adhered toners of standard uniform density image

| Amount of adhered toners (mg/cm$_2$) | Setting value of $V_B$ (V) | Temporary setting value of $V_O$ (V) |
|---|---|---|
| 1.2 | −150 | −400 |
| 1.1 | −160 | −425 |
| 1.0 | −180 | −475 |
| 0.9 | −200 | −525 |
| 0.8 | −240 | −630 |
| 0.7 | −290 | −760 |
| 0.6 | −300 | −785 |
| 0.5 | −300 | −785 |

Figure 11:
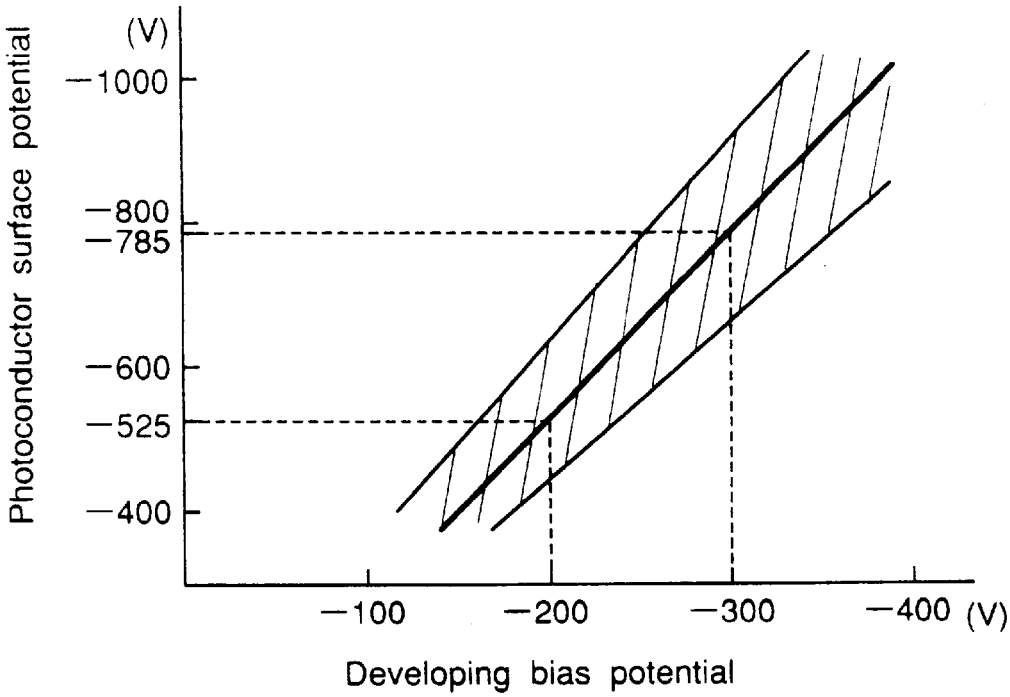
FIG. 11 is a graph on a relation of development bias voltage $V_B$ plotted against surface potential of the photoconductor drum set temporarily.

FIG. 11 shows a relation of development bias voltage $V_B$ plotted against surface potential of the photoconductor drum set temporarily. In FIG. 11, a central solid line shows a relation of development bias voltage $V_B$ plotted against surface potential $V_O$ which is thought to form an equivalent image, while the area plotted with hatching shows a measurement range of the image sensor 10 for measuring the area ratio. At step S3, the surface potential $V_O$ is set temporarily at a value in correspondence to the development bias voltage $V_B$ according to the solid line shown in FIG. 11 so that the area ratio of the standard dot toner image formed for detecting the dot size exists within the predetermined measurement range of the image sensor 10 expressed with hatching in FIG. 11. The upper limits of the development bias voltage $V_B$ and the surface potential $V_0$ are set at −300 V and at −785 V, and the difference between them is controlled not to exceed 485 V in order to prevent image noises such as a fog. In Table 1, the development bias voltage $V_B$ and the transfer voltage $V_T$ at 0.5 and at 0.6 of the amount of adhered toners are determined to satisfy these limits.

Then, a standard dot toner image is formed in the non-image area by using the setting values of $V_B$ and $V_O$ (step S4). Next, the area ratio of the standard dot toner image is detected with the image sensor 10 (step S5). If the absolute value of the value of $V_O$ set temporarily is less than the upper limit, 785 V (YES at step S6), the look-up table (or Table 2) stored in the memory 16 is referred to adjust the surface potential $V_O$ based on the detected area ratio and the temporal surface potential $V_O$ (step S7). In Table 2, the difference in area ratio of the standard dot toner image is expressed relative to that for the standard density.

Table 2 Adjustment value of surface potential for the temporal setting value of surface potential $V_O$ based on the area ratio and the temporal setting value of surface potential $V_O$

| Difference in area ratio of standard dot image (%) | Adjustment value (V) for various setting values of surface potential $V_O$: For $V_O$ of 0 to −500 V | For $V_O$ of −500 to −600 V | For $V_O$ of −600 to −785 V |
|---|---|---|---|
| +15 | −120 | −150 | −180 |
| +10 | −80 | −100 | −120 |
| +5 | −40 | −50 | −60 |
| 0 | 0 | 0 | 0 |
| −5 | +40 | +50 | +60 |
| −10 | +80 | +100 | +120 |
| −15 | +120 | +150 | +180 |
| −20 | +160 | +200 | +240 |

On the other hand, if the absolute value of the temporal setting value of the surface potential $V_O$ is above the upper limit, 785 V (NO at step S6), the surface potential $V_O$ is not changed as shown in Table 1 in order to prevent image noises such as a fog, and the development bias voltage $V_B$ is adjusted with referent to Table 3 stored in the memory 16 in a range which does not affect the amount (or thickness) of adhered toners largely in order to control the dot size (step S8). In Table 3, the difference in area ratio of standard dot toner image is expressed relative to that for the standard density, as in Table 2. The adjustment of the development bias voltage $V_B$ for changing the dot size is smaller than the counterpart of the surface potential $V_O$. Therefore, the change in the difference between the development bias voltage $V_B$ and the surface potential $V_O$ is decreased to suppress image noises.

TABLE 3

| Adjustment of development bias voltage $V_B$ based on area ratio: Difference in area ratio of standard dot image (%) | Adjustment value of $V_B$ (V) |
|---|---|
| +15 | −90 |
| +10 | −60 |
| +5 | −30 |
| 0 | 0 |
| −5 | +30 |
| −10 | +60 |
| −15 | +90 |
| −20 | +120 |

In a modified example, the dot size is controlled by increasing the intensity of laser beam emitted by the laser exposure unit 3 than the normal value, instead of controlling the development bias voltage. In this case, a difference between the development bias voltage and the surface potential $V_O$ can be suppressed effectively. If the dot size is controlled only by the intensity of the laser beam instead of the development bias voltage, variations of the amount (thickness) of adhered toners can be avoided.

Next, the control of transfer voltage $V_T$ is explained which is performed after setting the image forming conditions and before forming an actual image. In order to stabilize the image, the transfer efficiency has also to be stabilized. A toner image formed on the photoconductor drum 1 is carried to a transfer point to be transferred to the intermediate transfer unit to which the transfer voltage $V_T$ is applied by the power source 14 through the current detector 13. The transfer efficiency depends on the resistance value R of the intermediate transfer material and the amount of charges Q/M of toners, and the optimum transfer voltage $V_T$ shifts with the transfer efficiency. If the transfer voltage $V_T$ is insufficient, the toner image is not transferred sufficiently, and a transfer failure occurs. On the other hand, if the transfer voltage $V_T$ is excessive, charges injected to the toner image on the photoconductor drum 1 changes the polarity of the toners. Then, the transfer cannot be performed, and a transfer failure occurs.

Figure 12:
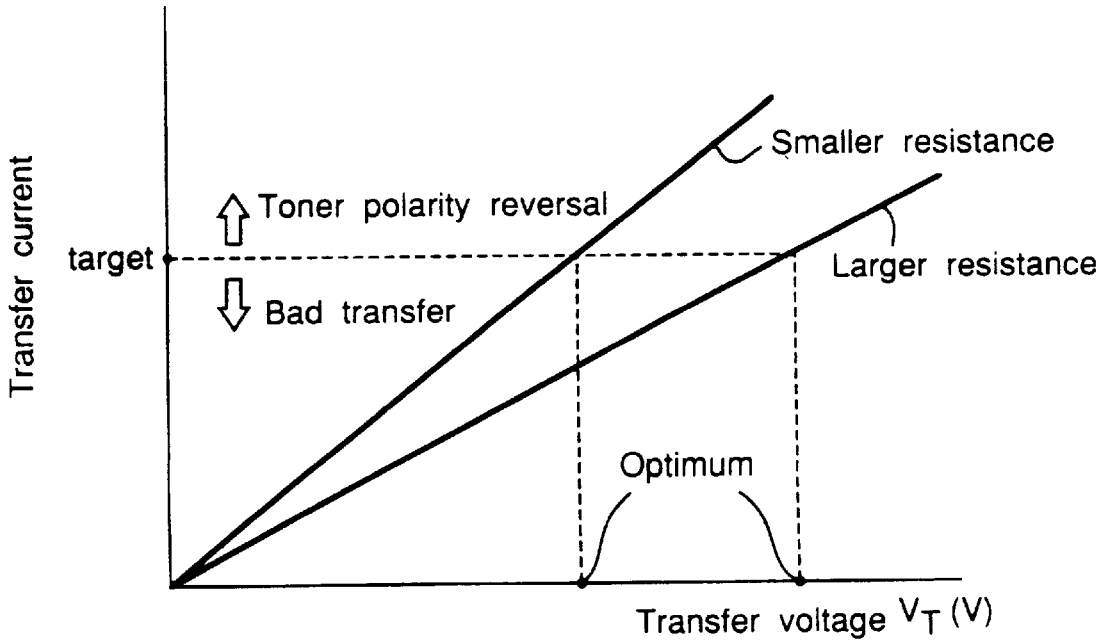
FIG. 12 is a graph of transfer current plotted against transfer voltage $V_T$.

FIG. 12 is a graph of the transfer current I plotted against transfer voltage $V_T$. In order to transfer a toner layer of a particular amount of toners with a particular amount of charges per weight Q/M, a transfer current equivalent to the total amount of charges of the toner layer is needed. The required current is constant and does not depend on the resistance R of the intermediate transfer material. However, the optimum transfer voltage $V_T$ for the necessary transfer current I is changed with the resistance R. Then, it is needed to adjust the transfer voltage $V_T$ on the basis of the resistance R.

The resistance R of the intermediate transfer material is detected as follows: First, the photoconductor drum 1 sensitized uniformly is exposed by the laser exposure unit 3, and a reverse bias voltage is applied to the development sleeve 15 in order to prevent toners from adhering to the exposed photoconductor drum 1. Then, a predetermined voltage is applied to the photoconductor drum 1 and the current flowing under the applied voltage is detected by the current detector 13. Thus, the resistance R is calculated from the applied voltage and the detected current. In a different way, the resistance is detected by flowing a predetermined current to the sensitized photoconductor drum 1 and by detecting the voltage at the same time. The transfer voltage $V_T$ is controlled according to the detected resistance R of the intermediate transfer material.

Figure 13:
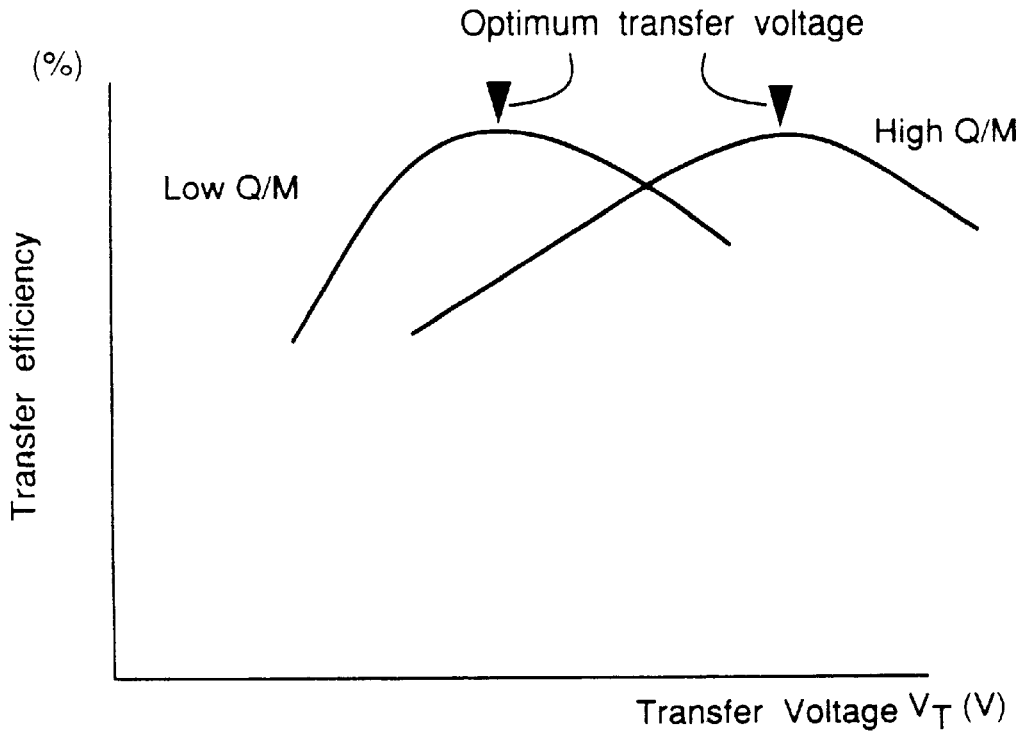
FIG. 13 is a graph of transfer efficiency plotted against transfer voltage $V_T$.

On the other hand, the optimum transfer voltage $V_T$ is affected by the charges per weight Q/M of the toners because the total amount of charges of the toner image depends on the charges per weight Q/M. FIG. 13 is a relation between the transfer efficiency and the transfer voltage $V_T$. The transfer voltage $V_T$ needed for optimum transfer efficiency is changed with the charges Q/M of the toners per weight. Then, the transfer voltage $V_T$ has also to be controlled according to the charges Q/M of the toners per weight. Therefore, the transfer voltage $V_T$ is controlled according to both the resistance R of the intermediate transfer material and the charges Q/M of the toners per weight.

As explained above, the charges Q/M of the toners can be predicted according to the amount of adhered toners of the standard uniform density toner image. Therefore, the transfer voltage $V_T$ can also be controlled according to both the resistance R of the intermediate transfer material and the amount of adhered toners of the standard uniform density toner image, as shown in Table 4.

Further, the charges Q/M of the toners can be predicted according to the development bias potential $V_B$ adjusted according to the amount of adhered toners of the standard uniform density toner image, as shown in Table 4. Therefore, the transfer voltage $V_T$ can also be controlled according to both the resistance R of the intermediate transfer material and the development bias potential $V_B$.

Table 4 shows a relation of the transfer voltage $V_T$ to be set in the control of image forming conditions to the development bias potential $V_B$, the predicted value of the charges Q/M of the toner image and the resistance R of the intermediate transfer material.

Table 4 Relation of the transfer voltage $V_T$ to the development bias potential $V_B$, the predicted value of the charges Q/M of the toner image and the resistance R of the intermediate transfer material

| Amount of adhered toners | Setting value of $V_B$ | Predicted charges (Q/M) on toners | Transfer voltage (V) for three belt resistances of $10^7$, $10^8$ and $10^9$ Ω | | |
|---|---|---|---|---|---|
| (mg/cm$^2$) | (V) | (μC/g) | $10^7$ | $10^8$ | $10^9$ |
| 1.2 | −150 | 10 | 0.34 | 0.54 | 0.74 |
| 1.1 | −160 | 12 | 0.44 | 0.64 | 0.84 |
| 1.0 | −180 | 14 | 0.54 | 0.74 | 0.94 |
| 0.9 | −200 | 17 | 0.64 | 0.84 | 1.04 |
| 0.8 | −240 | 21 | 0.74 | 0.94 | 1.14 |
| 0.7 | −290 | 26 | 0.84 | 1.04 | 1.24 |
| 0.6 | −300 | 32 | 0.94 | 1.14 | 1.34 |
| 0.5 | −450 | 40 | 1.04 | 1.24 | 1.44 |

Figure 14:
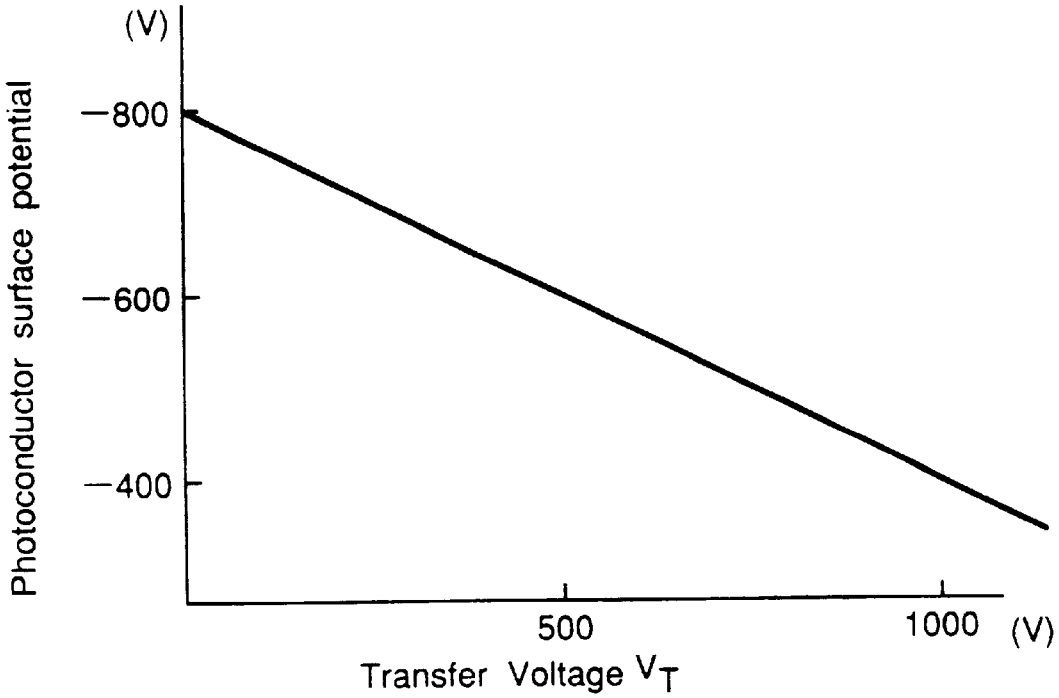
FIG. 14 is a graph on a relation of the transfer voltage $V_T$ plotted against the surface potential of the photoconductor drum.

It is to be noted that the transfer voltage $V_T$ is set according to the information such as the amount of adhered toners or the development bias voltage $V_B$) obtained to set the image forming conditions. Therefore, the transfer voltage $V_T$ has to be set after the information is obtained. FIG. 14 shows a relation of the transfer voltage $V_T$ plotted against the surface potential $V_T$ of the photoconductor drum 1 when a constant transfer voltage $V_T$ is applied to the transfer brush 2 by the power source 7. As shown in FIG. 14, when a constant transfer voltage $V_T$ is applied to the charging brush 2, the surface potential of the photoconductor drum 1 depends on the transfer voltage $V_T$. Then, the voltage $V_G$ applied by the power source 7 is adjusted so that the surface potential $V_O$ of the photoconductor drum 1 has the value to be set according to the image forming conditions in the actual image forming after the above-mentioned control of the transfer voltage $V_T$. For example, the output voltage $V_G$ of the power source 7 is adjusted according to the change of the transfer voltage $V_T$ set in the control of the transfer voltage $V_T$.

Figure 15:
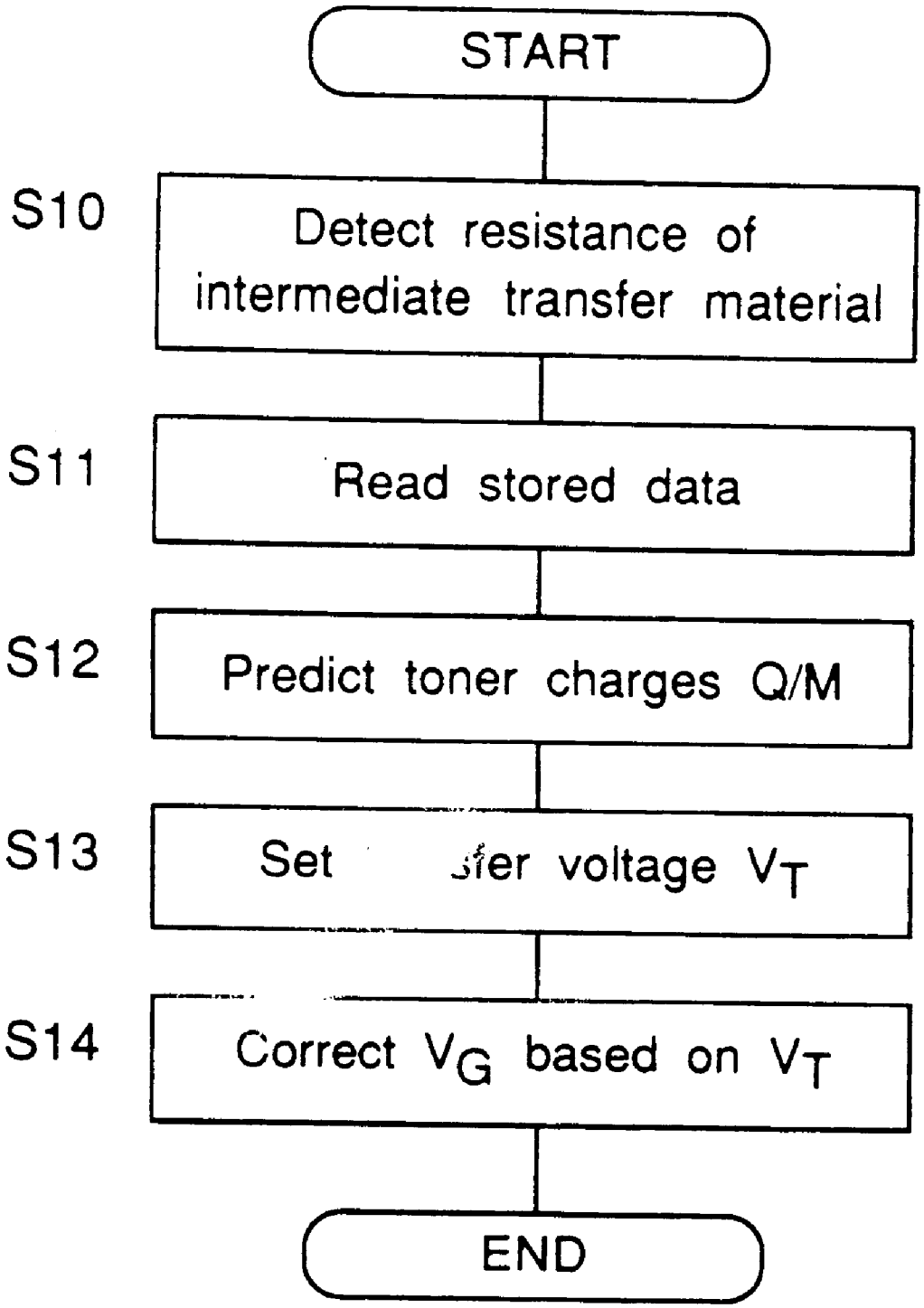
FIG. 15 is a flowchart for controlling the transfer voltage $V_T$.

FIG. 15 is a flowchart for controlling the transfer voltage $V_T$ performed by the printer controller 11 performed after controlling the image forming conditions. First, the resistance R of the intermediate transfer material is determined (step S10). Next, the amount of adhered toners detected in the control of the image forming conditions or the development bias voltage $V_T$ set in the control of the image forming conditions is read from the memory 16 (step S11). Then, the predicted value of the amount Q/M of charges of the toner image is obtained (step S12). Next, the transfer voltage $V_T$ is determined according to the resistance R determined at step S10 and the development bias voltage $V_B$ (step S13). In a different way, the transfer voltage $V_T$ is determined according to the resistance R determined at step S10 and the amount of adhered toners. In a still different way, the transfer voltage $V_T$ is determined according to the resistance R determined at step S10 and the amount of charges of the toner image. Then, the voltage $V_G$ applied to the charging brush 2 by the power source 7 is adjusted so that the surface potential $V_O$ of the photoconductor drum 1 has the value set in the above-mentioned control of the image forming conditions (step S14).

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An image forming apparatus comprising:

a photoconductor;

a charger for charging said photoconductor;

an exposure unit for exposing said photoconductor according to image data to form an electrostatic latent image on said photoconductor, said photoconductor being sensitized by said charger;

a development device operative for receiving a development bias potential and for adhering toners to the electrostatic latent image on said photoconductor to form a toner image;

a setting means for setting the development bias potential for said development device and a surface potential of said photoconductor according to the toner image formed by said development device;

a size change means for changing a size of dots for forming an image; and a controller for changing a changing process of said size change means for changing the dot size according to the surface potential set by said setting means.

2. The image forming apparatus according to claim 1, wherein said setting means comprises a first means for changing the dot size according to the surface potential and a second means for changing the dot size according to the development bias potential.

3. The image forming apparatus according to claim 2, wherein said setting means makes said first means change the dot size if the surface potential set by said setting means is smaller than a predetermined potential and makes said second means change the dot size otherwise.

4. The image forming apparatus according to claim 2, wherein said setting means has a table on the surface potential against the amount of adhered toners.

5. The image forming apparatus according to claim 2, wherein the surface potential of said photoconductor to be set is within a predetermined difference from the development bias potential.

6. The image forming apparatus according to claim 1, wherein said setting means has a table on the surface potential against the amount of adhered toners.

7. The image forming apparatus according to claim 1, wherein the surface potential of said photoconductor to be set is within a predetermined difference from the development bias potential.

8. An image forming apparatus comprising:

a photoconductor;

a charger for charging said photoconductor;

an exposure unit for exposing said photoconductor according to image data to form an electrostatic latent image on said photoconductor, said photoconductor being sensitized by said charger;

a development device operative for receiving a development bias potential and for adhering toners to the electrostatic latent image on said photoconductor to form a toner image;

a first controller for making said charger, said exposure unit and said development device form a uniform density toner image with a predetermined development bias potential and predetermined surface potential;

a first detector for detecting an amount of adhered toners of the uniform density toner image formed on said photoconductor by said first controller;

a setting means for setting the development bias potential for said development device and a surface potential of said photoconductor to be set by said charger according to the amount of toners detected by said first detector;

a second controller for making said charger, said exposure unit and said development device form a dot toner image on said photoconductor with the development bias potential and the surface potential set by said setting means;

a second detector for detecting an area ratio of the dot toner image formed on said photoconductor by said second controller; and a readjusting means for readjusting the surface potential of said photoconductor according to the surface potential and the area ratio detected by said second detector.

9. The image forming apparatus according to claim 8, wherein said setting means has a table on the surface potential of said photoconductor against the amount of the adhered toners.

10. The image forming apparatus according to claim 9, wherein the surface potential of said photoconductor to be set is within a predetermined difference from the development bias potential.

11. The image forming apparatus according to claim 8, wherein the surface potential of said photoconductor to be set is within a predetermined difference from the development bias potential.

* * * * *